US006681612B2

(12) United States Patent
Matsumoto et al.

(10) Patent No.: US 6,681,612 B2
(45) Date of Patent: Jan. 27, 2004

(54) METHOD OF MANUFACTURING A CURVED METAL PLATE, AND GOLF CLUB HEAD

(75) Inventors: Satoshi Matsumoto, Osaka (JP); Nozomu Ariyasu, Osaka (JP); Chon Chen Lin, Ping-Tung Hsien (TW)

(73) Assignees: Sumitomo Metal Industries, Ltd. (JP); O-TA Precision Industry Co., Ltd. (TW)

( * ) Notice: Subject to any disclaimer, the term of this patent is extended or adjusted under 35 U.S.C. 154(b) by 0 days.

(21) Appl. No.: 10/004,931

(22) Filed: Dec. 7, 2001

(65) Prior Publication Data

US 2002/0107090 A1 Aug. 8, 2002

(30) Foreign Application Priority Data

Dec. 8, 2000 (JP) ..... 2000-373860
Dec. 3, 2001 (JP) ..... 2001-368941

(51) Int. Cl.[7] ..... B21D 17/02; B21J 13/02
(52) U.S. Cl. ..... 72/415; 72/352
(58) Field of Search ..... 72/415, 414, 352, 72/358

(56) References Cited

U.S. PATENT DOCUMENTS

| | | | | | |
|---|---|---|---|---|---|
| 520,289 | A | * | 5/1894 | Barr | 72/414 |
| 4,055,975 | A | * | 11/1977 | Serfozo et al. | 72/352 |
| 4,113,522 | A | * | 9/1978 | Hamilton et al. | 72/358 |
| 5,141,231 | A | * | 8/1992 | Cox | 473/330 |
| 5,553,476 | A | * | 9/1996 | Oehy et al. | 72/325 |
| 5,868,026 | A | * | 2/1999 | Sarkisian et al. | 72/356 |
| 6,227,985 | B1 | * | 5/2001 | Mizushima et al. | 473/319 |
| 6,381,828 | B1 | * | 5/2002 | Boyce et al. | 29/527.4 |
| 6,428,427 | B1 | * | 8/2002 | Kosmatka | 473/349 |

* cited by examiner

*Primary Examiner*—Daniel C. Crane
(74) *Attorney, Agent, or Firm*—Sterne, Kessler, Goldstein & Fox P.L.L.C.

(57) ABSTRACT

A method of manufacturing a curved metal plate includes pressing a metal plate made of a plate material selected from titanium or titanium alloy with a die segment that forms thereon a convex surface curving in at least one direction and at least one recess, with a first side of the metal plate in contact with the convex surface, thereby curving the metal plate along the convex surface while allowing a part of the plate material on the first side of the metal plate to intrude into the at least one recess under pressure, thus forming at least one rib on the first side of the metal plate.

19 Claims, 7 Drawing Sheets

METHOD OF MANUFACTURING A CURVED METAL PLATE, AND GOLF CLUB HEAD

BACKGROUND OF THE INVENTION

1. Field of the Invention

The present invention relates to a method of manufacturing a curved metal plate made of titanium or titanium alloy, and a golf club head using a plate of metal such as titanium alloy with ribs formed thereon manufactured by the press-bending technique.

2. Discussion of the Background

Titanium alloys have been hitherto used as materials for airplane and automobile parts, medical instruments, etc., because they exhibit high strength in spite of their relatively small specific gravity. In recent years, those titanium alloys are broadly used for such as golf, bicycle and other sporting and leisure equipment. Specifically, a cast product using Ti-6Al-4V is used particularly for fabricating a golf club head, because it better fits to a complicated shape of the golf club head. However, this product poses a problem of increasing the manufacturing cost and weakening the strength of the golf club head.

As a different approach to producing a desirable material for the golf club head, a metal plate made of SP700 having a hot workability or Ti-15V-3Al-3Cr-3Sn having a cold workability is plastically deformed to form a product for use in the golf club head.

Japanese Patent Publication No. 2640415 discloses one example of methods of manufacturing a driver head of the golf club. The method includes cold- or hot-pressing metal plates made of titanium alloy comprised of 10–25 wt. % of vanadium, and one or at least two metals selected from 2–5 wt. % of aluminum, 2–5 wt. % of chrome and 2–4 wt. % of tin into predetermined shapes, thereby forming parts of the driver head. Parts obtained in this manner are welded together to fabricate a driver head.

The above method using the titanium alloy as disclosed in the aforesaid Japanese patent publication requires such a large load as to plastically deform a titanium alloy or other plate material into a complicated shape of a golf club head or any other products. In addition, even if the metal plate made of titanium or titanium alloy has been press bent, it may be returned to nearly an original shape because titanium or titanium alloy has a substantial springback force. As a result, the manufacturing of a curved metal plate by the plastically deforming process involves a great difficulty.

In consideration of the above problem, it is an object of the present invention to provide a method of manufacturing a desirably curved metal plate even with a relatively small pressure load.

It is another object of the present invention to provide a golf club head with an excellent strength characteristics that can be securely manufactured by a press working.

SUMMARY OF THE INVENTION

Although even the conventional manufacturing method can achieve the reduction of the pressure load by reducing a contacting surface of a die to a workpiece, it would be hard to plastically deform the entire portion of the metal plate merely by reducing the die in size.

The present inventors studied and found that the contact surface of the metal plate to the die can be reduced by forming a recess such as in the form of a groove or hole on a die for press-bending a metal plate, and such a reduction results in a substantial reduction of the load regardless of the size of the die and hence a smaller springback force. The present inventors thus have achieved the present invention.

Specifically, a method of manufacturing a curved metal plate includes pressing a metal plate made of a plate material selected from titanium or titanium alloy with a die segment that forms thereon a convex surface curving in at least one direction and at least one recess, with a first side of the metal plate in contact with the convex surface, thereby curving the metal plate along the convex surface while allowing a part of the plate material on the first side of the metal plate to intrude into the at least one recess under pressure, thus forming at least one rib on the first side of the metal plate.

In the above method, the metal plate in contact with the convex surface of the die with the recess formed thereon is pressed by the die. Because the plate material intrudes into the recess under pressure, the recess can facilitate the flowing of the plate material during the press-bending operation. Furthermore, the recess is designed so that the plate material is prevented from filling in the recess. As a result, the contacting surface of the die and the workpiece is reduced, thereby achieving the reduction of the pressure load.

Because the plate material intrudes into the recess, the plate material on the first side contacting the recess is held by the recess, while increasing its tension force on a second side of the metal plate opposite to the first side. As a result, it is possible to restrain the curved metal plate to return to its original shape due to the springback force.

The recess may be formed in a groove, elongated groove or any other shape, of which the groove shape having at least a portion crossing the at least one direction along which the convex surface is curved is preferable. A plurality of recesses may be formed on the convex surface of the die. In such an arrangement, at least one of the plurality of recesses is preferably formed in a groove shape that has at least a portion crossing the at least one direction along which the convex surface is curved.

According to these preferred embodiments, during the press working of the metal plate, the plate material on the first side or the inwardly curving side converging in the direction along which the metal plate is curved securely intrudes into the recess or groove which has at least a portion crossing the direction along which the metal plate is curved. As a result, it can produce the aforesaid desirable effects that the metal plate is securely curved even with a relatively small pressure load, while more securely limiting the springback force.

Titanium or titanium alloy constituting the metal plate does not necessarily have a specific composition. However, beta-titanium alloy is preferable from the view point of the strength and any other properties. Particularly, titanium alloy having the following composition (wt. %): vanadium 15–25, aluminium 2.5–5, and tin 0.5–4 is more preferable.

The curved metal plate manufactured by the above method eventually forms thereon at least one rib or protrusion by the plate material intruding into the recess. The rib enhances the strength of the curved metal plate against an impact applied on the surface of the metal plate in the vertical direction, thereby reinforcing the curved metal plate.

Accordingly, a golf club head having at least a part formed from the curved metal plate manufactured by the present method has an excellent strength due to not only a material superiority of the titanium or titanium alloy, but also the shape of the metal plate.

Particularly, a beta-titanium alloy having the following composition (wt. %): vanadium 15–25, aluminium 2.5–5, tin 0.5–4, and titanium and unavoidable impurities constitute the residue is preferable when it is used for a golf club head, because it possesses a property achieving a higher strength after aging.

DETAILED DESCRIPTION OF THE PREFERRED EMBODIMENT

The present invention is directed to a method of manufacturing a metal plate made of a plate material selected from titanium or titanium alloy having a predetermined shape by plastically deforming the metal plate under pressure by utilizing a convex surface formed in a die. Because the titanium or titanium alloy can have a varying composition, a conventional titanium or titanium alloy may be used. For example, it can be cited pure titanium, beta-titanium alloy, alpha-beta titanium alloy, or beta-titanium alloy having the following composition (wt. %): V 15–25, Al 2.5–5, Sn 0.5–4, O 0.12 or less, and Ti and unavoidable impurities constitute the residue (as disclosed in Japanese Patent No. 2669004), or V 10–25, Al 2–5, Cr 2–5, Sn 2–4, O 0.25 or less, and Ti and unavoidable impurities constitute the residue (as disclosed in Japanese Patent No. 2640415). Of these compositions, it is preferable to use the beta-titanium alloy having the following composition (wt. %): V 15–25, Al 2.5–5, Sn 0.5–4, O 0.12 or less, and Ti and unavoidable impurities constitute the residue, because it exhibits excellent product strength and workability for plastic deforming.

A metal plate used in the present invention can be obtained from titanium or titanium alloy which is cold- or hot-rolled, additionally subjected to solution treatment thereafter, or cold- or hot-rolled after it is subjected to solution treatment. The thickness of the metal plate is not necessarily limited to a specific value, provided that the metal plate formed can be plastically deformed with pressure. For example, it can be cited a metal plate having a thickness of about 0.1–15 mm, and preferably about 0.5–5 mm.

As a die used in the manufacturing method of the present invention, it can be cited, for example, a die assembly provided with a concave surface and a convex surface with only the convex surface forming recesses thereon, between which surfaces the metal plate is pressed into a curved shape.

Figure 1:
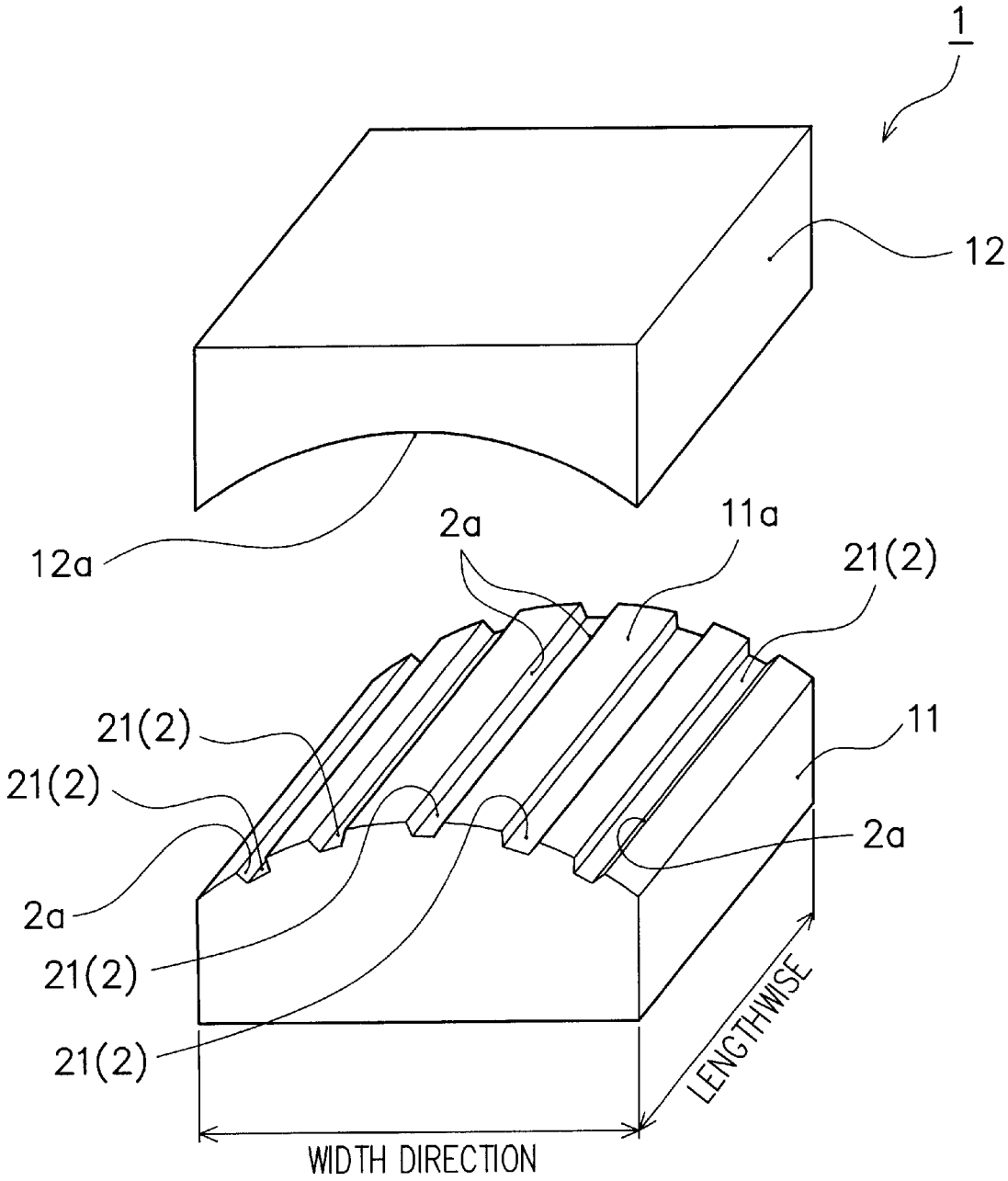
FIG. 1 is a reference perspective view illustrating one embodiment of a die assembly used for the manufacturing method of the present invention.

FIG. 1 illustrates die assembly 1 as an example of the die of the present invention, which includes fixed die segment 11 with convex surface 11*a* formed thereon, and movable die segment 12 with concave surface 12*a* formed thereon. The convex surface 11*a* in turn forms thereon recesses 2, while the concave surface 12*a* is formed with a smooth surface configuration. The recesses 2 as illustrated in FIG. 1 are respectively grooves 21 each having a portion crossing or preferably as in this embodiment substantially orthogonal to the direction along which the convex surface 11*a* of the die 1 is curved. In this embodiment, five grooves 21 are positioned substantially parallel to each other on each convex surface 11*a*. The die segment having the convex surface 11*a* is not necessarily limited to a fixed type, but may be of a movable type. Also, both die segments 11*a,* 12*b* may be designed as a movable type.

In the description, the direction along which the metal plate is curved represents a direction along which the convex surface of the die segment extends. Where the convex surface is formed with a linear apex and is curved around an axis parallel to the linear apex or an axis parallel to the lengthwise direction in FIG. 1, the direction crossing or orthogonal to the direction along which the metal plate is curved represents a direction crossing or orthogonal to both tangential and normal lines of the outline of the convex surface in a cross-sectional view taken along an imaginary surface that crosses or is orthogonal to the axis.

Although the number of the recesses 2 formed on the convex surface 11*a* may be varied and therefore a single recess or plural recesses with respect to the convex surface 11*a* may be formed, it is preferable to form at least two recesses for increasing portions into which a plate material intrudes. In order to achieve equalized distribution of the intruded plate material, it is preferable to dispose the recesses 2 at equal spacing, as illustrated in FIG. 1. However, it is possible to dispose all or part of the recesses 2 at different spacing. Also, it is preferable to have side faces 2*a* of the recesses 2 each slantingly extending to form gradually enlarging recesses as advancing towards the convex surface 11*a*.

Figure 2:
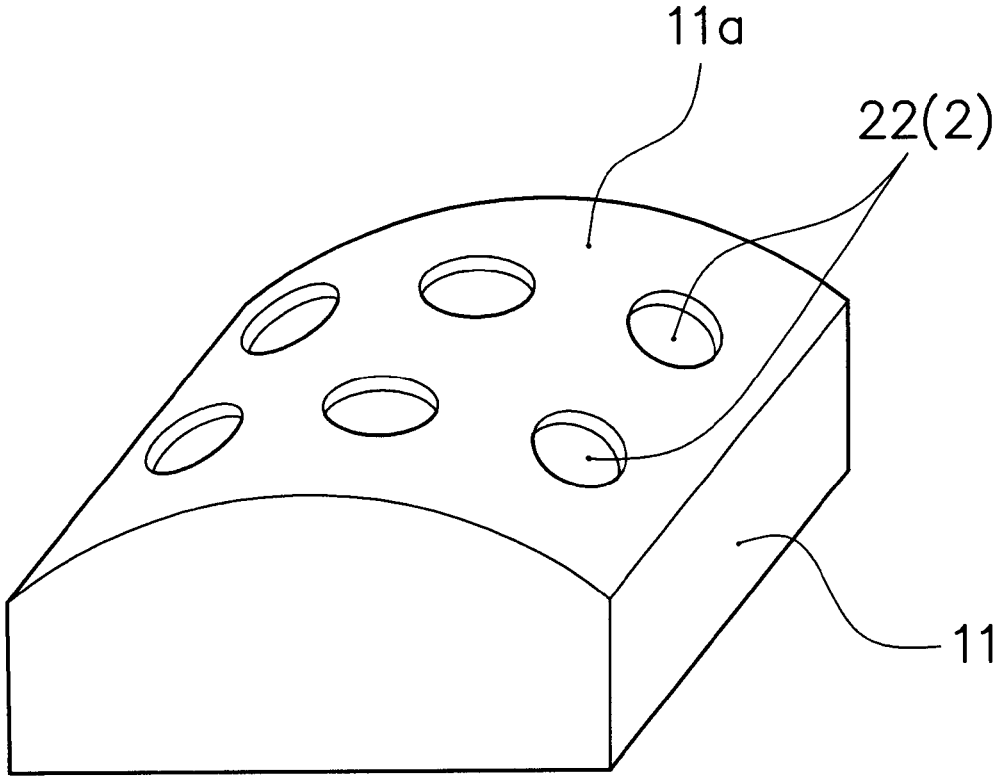
FIG. 2 is a reference perspective view illustrating a modified example of a die segment.
Figure 3:
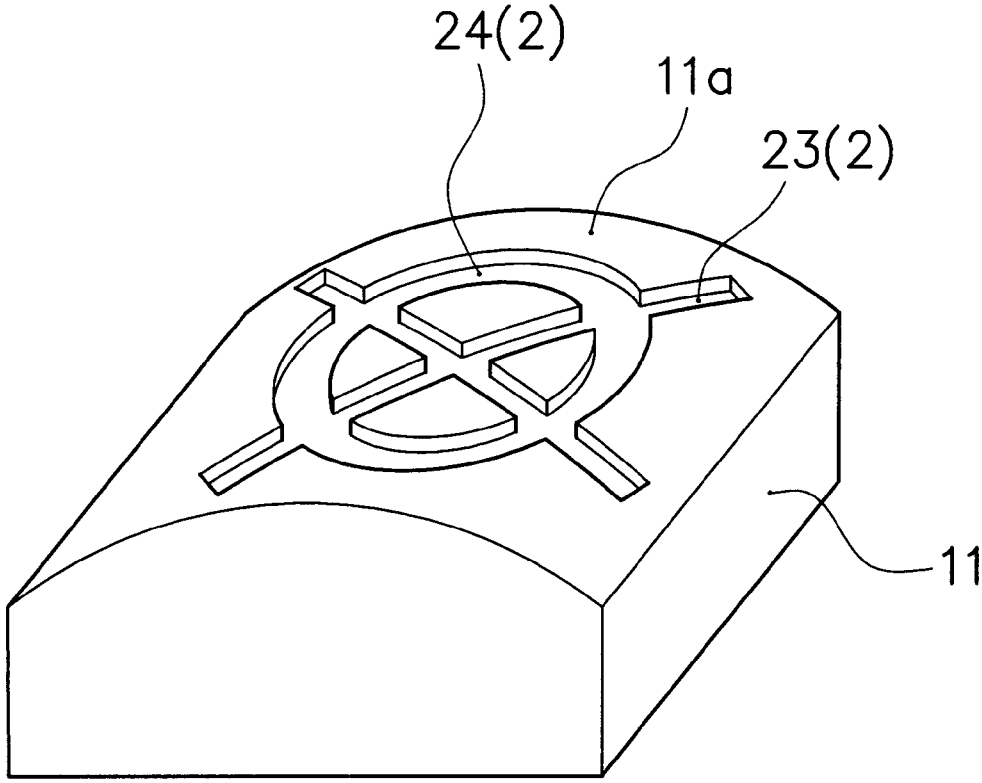
FIG. 3 is a reference perspective view illustrating another modified example of the die segment.

The recesses 2 each do not necessarily have the shape as illustrated in FIG. 1, and may be formed into holes 22, as illustrated in FIG. 2. As another modified example, the recesses 2 may be the combination of linear grooves 23 and circular groove 24. As still another modified example, the recesses 2 may be the combination of holes and grooves (not shown). As another modified example, the recesses 2 may be the combination of grooves crossing or substantially orthogonal to and those not crossing or not orthogonal to the direction along which the convex surface extends.

Figure 4A:
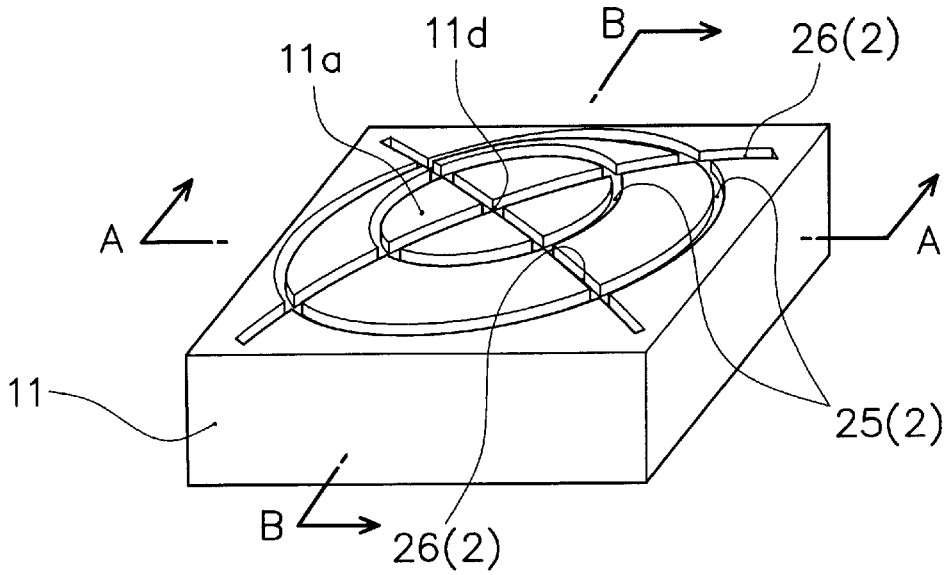
FIG. 4A is a perspective view illustrating still another modified example of the die segment.
Figure 4B:
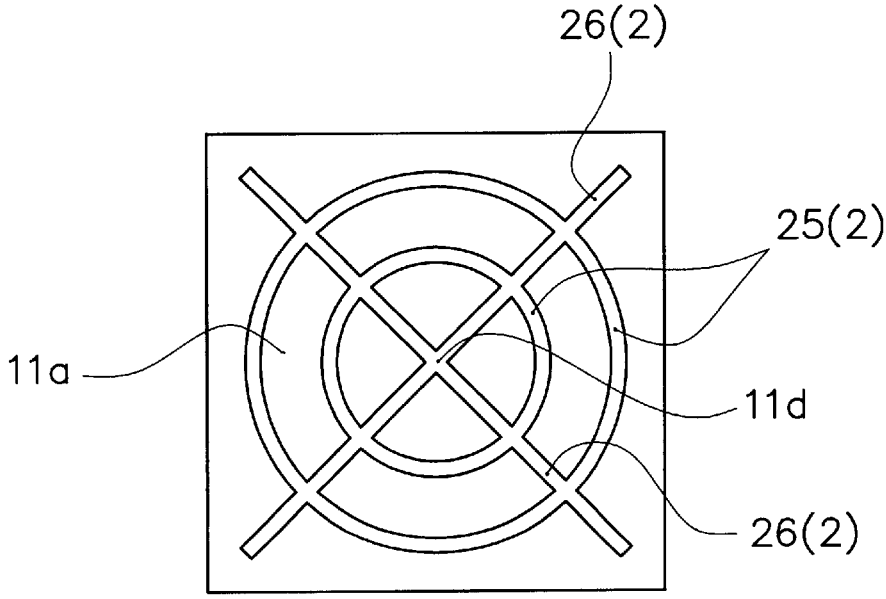
FIG. 4B is a plan view of the die as illustrated in FIG. 4A.
Figure 5A:
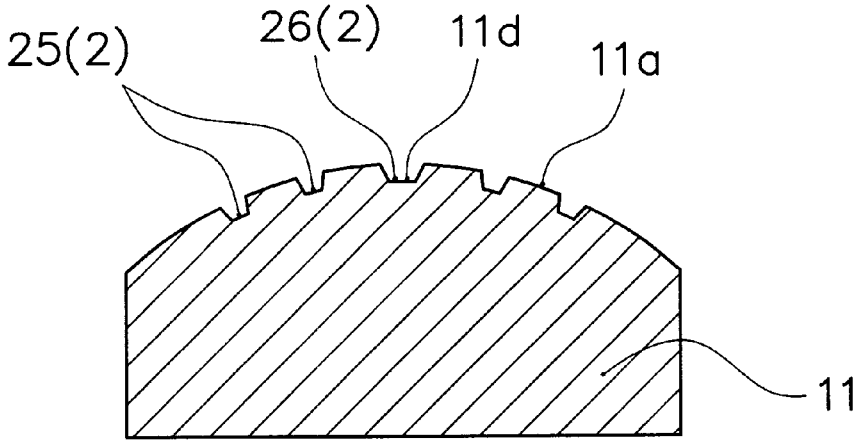
FIG. 5A is an end face view taken along the line A—A in FIG. 4A.
Figure 5B:
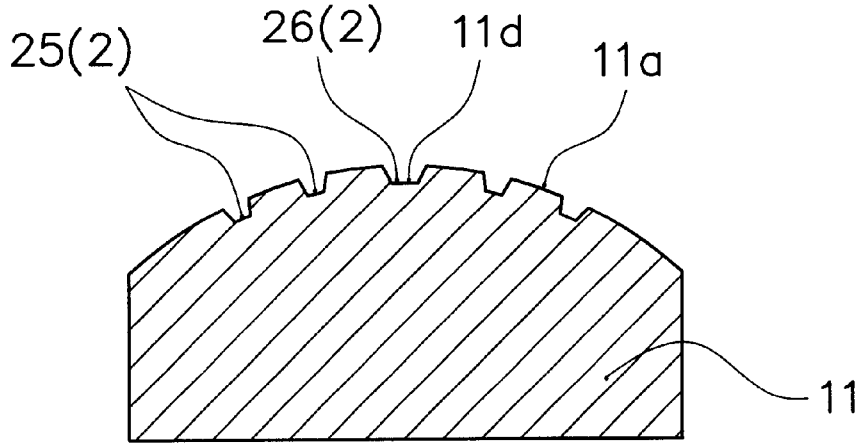
FIG. 5B is an end face view taken along the line B—B in FIG. 4A.

The convex surface 11*a* is not limited to the one curving in one direction, as illustrated in those Figures. Rather, it is possible to employ the die segment 11 having a convex surface resembling such as reverse-cup shape with apex 11*d,* as illustrated in FIGS. 4 and 5. Although the convex surface 11*a* with the apex 11*d* may be provided with the recesses 2 as exemplified in the above embodiments, the recesses 2 of this arrangement are preferably formed as the circular recesses coaxially arranged around the apex 11*d,* and more preferably with the combination of these circular recesses and recesses 26 substantially radially extending from the apex 11*d*. In this embodiment, either or both of substantially coaxial recess 25 and/or substantially radially extending recess 26 may be limited to one recess only. However, it is preferable to form at least two recesses respectively.

Where the convex surface is formed with a pointed apex, as illustrated in FIGS. 4A and 4B, the direction crossing or orthogonal to the direction along which the metal plate is curved represents a direction crossing or orthogonal to both tangential and normal lines of the outline of the convex surface in a cross-sectional view of an arbitrary point taken along an imaginary surface that extends along the pressing direction.

Accordingly, in the embodiment as illustrated in FIGS. 4A and 4B, both the substantially coaxial recesses 25 around the apex 11*d* and the substantially radially extending recesses from the apex 11*d* each have a portion crossing or orthogonal to the direction along which the metal plate is curved.

By pressing a metal plate with the die assembly 11 provided with the convex surface 11*a* with the apex 11*d* as described above, a curved metal plate with a center region outwardly bulging can be manufactured. This method is suitable particularly for manufacturing a curved metal plate used for a golf club head.

Although the thickness of each recess 2 may be varied, it is preferably set so as not to enable the plate material flowing during the pressing work to fill in the recess 2. This is because the plate material which has been excessively filled in the recesses 2 during the pressing work no longer intrudes into the recesses, and therefore the reduction of the pressure load by the recesses cannot be expected. Accordingly, the recesses 2 each are sized to have a thickness greater than the height of each rib of the curved metal plate to be formed by the pressing work. Specifically, each recess has a thickness of approximately 0.5 mm or more, and more preferably 1.0 mm or more.

The curvature of the convex surface 11*a* of the die assembly 1 is not necessarily limited to a specific value. However, with about 15 or less inch (about 380 mm) radius of curvature and preferably 6–15 inch (about 152–380 mm) radius of curvature, the desirable effect produced by the method of the present invention can most effectively be enjoyed.

Figure 6A:
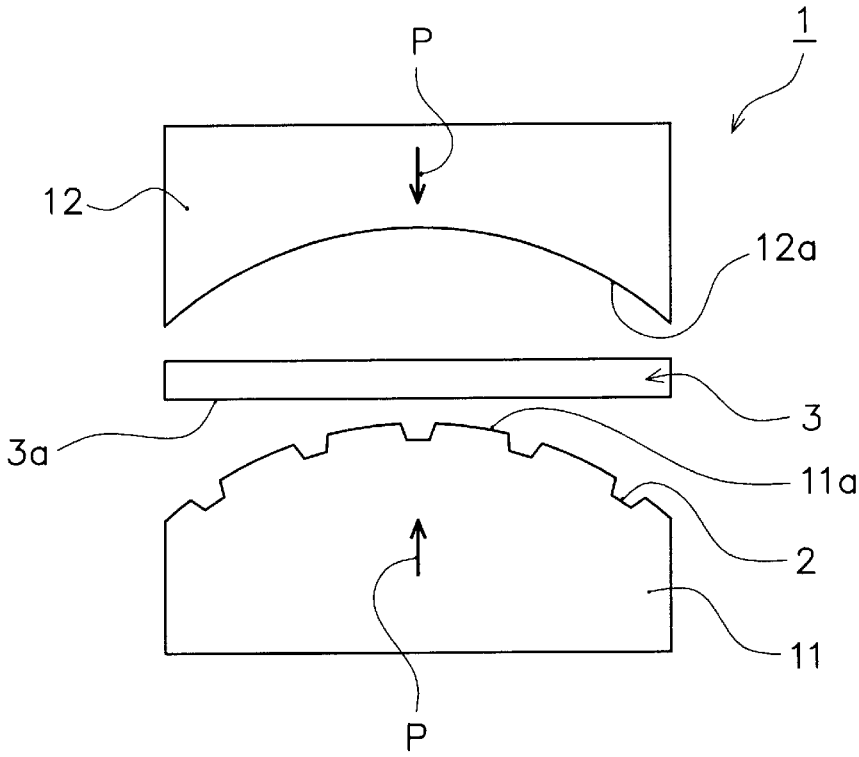
FIGS. 6A and 6B are reference side views respectively illustrating states of a metal plate before and during the pressing operation.
Figure 6B:
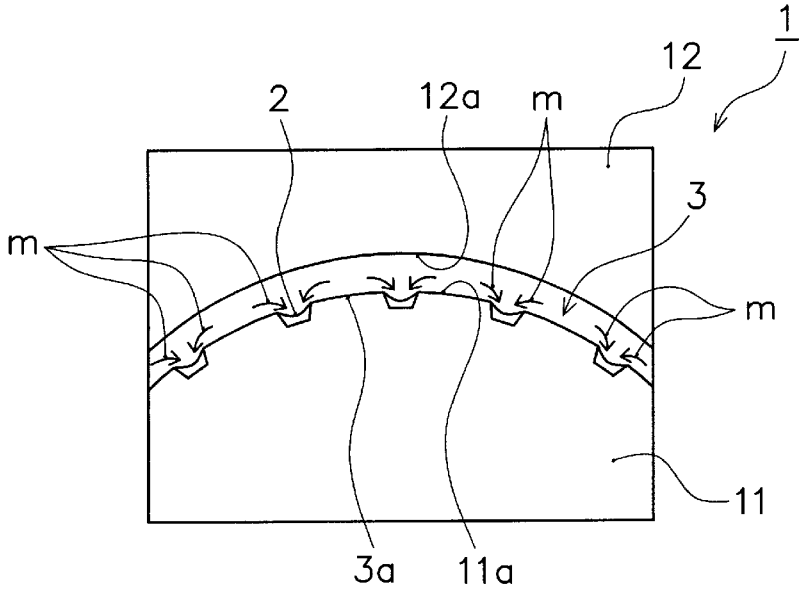

As illustrated in FIG. 6A, the metal plate 3 is placed between the fixed and movable die segments 11 and 12 with surface 3*a* of the metal plate 3 facing the fixed die segment 11, and then pressed by the movable die segment 12 (arrow P), so that the metal plate 3 is pressed into a curved configuration along the convex surface 11*a* and the concave surface 12*a* of the die segments, as illustrated in FIG. 6B. Under pressure, the plate material closer to the surface 3*a* (i.e., inwardly curved surface) of the metal plate 3 intrudes into the recesses 2 of the convex surface 11*a* (arrow m), so that the curved metal plate with rib(s) can be produced by the pressing work.

According to the method of the present invention, it is possible to produce a curved metal plate by a relatively small pressure load, which is mostly free of springback even after the press working. As a result, a curved metal plate having a relatively complicated shape can be manufactured at low cost without necessity of a large-scaled equipment.

The thus manufactured curved metal plate can be used without being subjected to any further process, or die-cut or cut into a varying shape for use in various products.

As a product for which the curved metal plate obtained according to the present invention is used, it can be cited sporting and leisure equipment such as a golf club head, bicycle, and various industrial products represented by automobile and aircraft.

Particularly, the curved metal plate of the present invention is suitably applied to a product, which frequently receives impacts through its face, such as a golf club head, and more particularly a striking plate, because the inwardly curved surface of the metal plate is provided with ribs.

The golf club head to which the curved metal plate is applicable is not limited to a specific type of the club, but includes wood-type club, iron-type club or any other types of clubs having various shapes and structures. Also, the curved metal plate of the present invention can be used as a constitutional part of the golf club head such a striking plate. It is also possible to use a single curved metal plate or plural curved metals in one product.

Figure 7A:
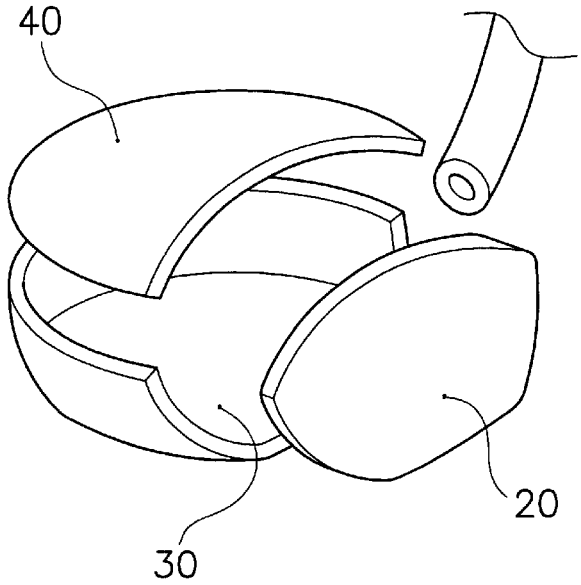
FIGS. 7A and 7B are exploded perspective views of a golf club head according to one embodiment of the present invention using a curved metal plate of the present invention.
Figure 7B:
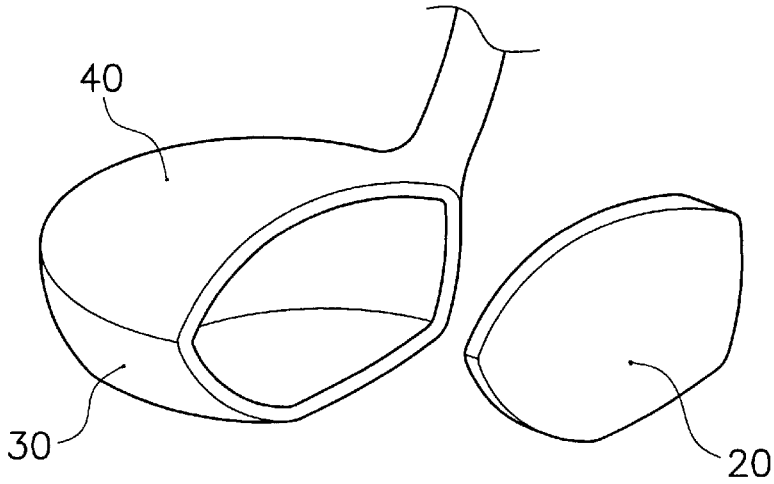

Specifically, as illustrated in FIG. 7A, the curved metal plate of the present invention is used as a striking plate 20, while cast metal plates of such as titanium alloy are used as sole plate 30, crown plate 40 or any other plates than the striking plate 20, and those plates are welded together to fabricate a golf club head. As a different arrangement as illustrated in FIG. 7B, the curved metal plate of the present invention is used as the striking plate 20 and welded to the sole plate 30 and the crown plate 40 which have been integrally cast with each other, thereby fabricating the golf club head.

It is also possible to fabricate a golf club head with the face plate 20, the sole plate 30 and the crown plate 40, all of which being formed from the curved metal plates of the present invention. Alternatively, the golf club head with the striking plate 20 and the crown plate 40 respectively formed from the curved metal plates of the present invention may be fabricated.

Testing Examples

The description will be hereinafter made in more detail for the present invention with reference to the testing examples and comparative examples.

Metal Plate Formed for Testing

A raw plate material comprised of titanium alloy having a composition: Ti-20V-4Al-1Sn and a plate thickness of 5.0 mm was solution treated to produce a cold-rolled plate having a plate thickness of 3.0 mm and size of 50 mm long and 50 mm wide. This plate will be hereinafter referred to metal plate A.

A raw plate material comprised of titanium alloy having a composition: Ti-20V-4Al-1Sn and a plate thickness of 5 mm, which has been subjected to the solution treatment, was cold-rolled to produce a cold-rolled plate having a plate thickness of 3.0 mm and size of 50 mm long and 50 mm wide. This plate will be hereinafter referred to metal plate B.

EXAMPLE 1

A fixed die segment, which has a convex surface with a curvature of 200 mm, a width of 50 mm and length of 50 mm in plan (see FIG. 1), and five grooves each having a width of 2 mm and thickness of 1.0 mm and extending orthogonal to the direction along which the convex surface extends and being disposed parallel to each other at equal spacing, and a movable die segment, which has the same curvature as the fixed die segment and a concave surface having a smooth surface configuration were prepared.

COMPARATIVE EXAMPLE 1

Die segments having the same arrangements as the above excepting for the absence of grooves (i.e., with smooth surface configuration) were prepared.

Pressing work for metal plate

The metal plates A and B were pressed and deformed to each have a thickness of 2.5 mm by using the die segments in the above examples. Whereby, the metal plates were curved. The surfaces of those die segments were lubricated during the pressing work. The pressure load applied to each metal plate during the pressing work, and the curvature radius of each metal plate after the pressing work are shown in Table 1.

TABLE 1

| | | Pressure load (MT) | Curvature (mm) |
|---|---|---|---|
| Example 1 | Metal plate A | 340 | 205 |
| | Metal plate B | 400 | 300 |
| Comparative Example | Metal plate A | 700 | 220 |
| | Metal plate B | 780 | Maintained in a flat configuration |

As is apparent from Table 1, in both the metal plate A to which the solution treatment was applied after cold-rolling and the metal plate B to which the solution treatment was not applied after the cold-rolling, it was confirmed that only those formed by using the die segments with the grooves exhibited substantial reduction of the pressure load.

With respect to the radius curvature, the metal plates which were subjected to the plastic forming by using the grooved die segments exerted only a smaller springback force, while those formed by using the non-grooved die segments exerted a larger springback force. Particularly, the metal plate which was not subjected to the solution treatment after cold-rolling was hardly bent and therefore not maintained in a curving configuration.

EXAMPLE 2

Curved metal plates having different thicknesses were produced in the same manner as in the Example 1 by using metal plates A having different plate thicknesses, and respectively used as striking plates, so that number 1 hollowed wood clubs for general purpose were fabricated. The strength test was conducted by striking golf balls three thousand times on striking faces (curved metal plates) of the wood clubs by using a robot machine with a head speed of 50 m/sec. As a result, it was observed no or little depressed areas, cracks or any other deformations on the striking faces of curved metal plates having a thickness of at least 2.6 mm (thickness of at least 2.4 mm in regions corresponding to the recesses).

COMPARATIVE EXAMPLE 2

A raw plate material comprised of titanium alloy having a composition: Ti-15V-3Al-3Sn-3Cr was cold-rolled, thereby forming cold-rolled plates having different plate thicknesses. These plates were subsequently subjected to the solution treatment in the same manner as in the Comparative Example 1. Thus, curved metal plates with no ribs having different thicknesses were produced. They were also subjected to the strength test in the same manner as in the Example 2. As a result, it was confirmed that only the metal plates having a thickness of at least 2.8 mm could obtain enough strength.

COMPARATIVE EXAMPLE 3

Titanium alloy (alpha-beta type) having a composition: Ti-6Al-4V was cast so that curved metal plates having different thicknesses were produced. The thus produced metal plates were subjected to the strength test in the same manner as in the Example 2. As a result, only the metal plates having a thickness of at least 3.0 mm could obtain enough strength.

As is apparent from the above, the curved metal plates of the Example 2 exhibit excellent strength even with the thin structure.

This specification is by no means intended to restrict the present invention to the preferred embodiments set forth therein. Various modifications to the method of manufacturing a curved metal plate, and a golf club head using the curved metal plate, as described herein, may be made by those skilled in the art without departing from the spirit and scope of the present invention as defined in the appended claims.

What is claimed is:

1. A method of manufacturing a curved metal plate comprising:

preparing a first die segment having a convex surface formed thereon, in which said convex surface is formed with a linear apex and is curved in a direction around an axis parallel to the linear apex, and said convex surface has at least one recess that has at least a portion orthogonal to the direction along which the convex surface is curved, in which said direction orthogonal to the direction along which said convex surface is curved represents a direction orthogonal to both tangential and normal lines of the outline of the convex surface in a cross-sectional view taken along an imaginary surface that is orthogonal to said axis;

preparing a second die segment having a concave surface formed thereon corresponding in shape to said convex surface; and pressing a metal plate made of a plate material selected from titanium or titanium alloy with said first and second die segments, with a first side of said metal plate held in contact with said convex surface of the first die segment, thereby curving said metal plate while forming at least one rib on the first side of the metal plate through said at least one recess of said convex surface.

2. A method of manufacturing a curved metal plate according to claim 1, wherein said at least one recess comprises grooves extending orthogonal to the direction along which the convex surface is curved.

3. A method of manufacturing a curved metal plate according to claim 1, wherein said at least one recess comprises at least one hole having a substantially circular shape in plan view.

4. A method of manufacturing a curved metal plate according to claim 1, wherein said at least one recess comprises at least one groove having a linear shape in plan view and at least one groove having a circular shape in plan view.

5. A method of manufacturing a curved metal plate comprising:

preparing a first die segment having a convex surface formed thereon, in which said convex surface is formed with a pointed apex, and said convex surface has at least one recess that has at least a portion orthogonal to the direction along which the convex surface is curved, in which said direction orthogonal to the direction along which said convex surface is curved represents a direction orthogonal to both tangential and normal lines of the outline of the convex surface in a cross-sectional view of an arbitrary point taken along an imaginary surface that extends along the pressing direction;

preparing a second die segment having a concave surface formed thereon corresponding in shape to said convex surface; and pressing a metal plate made of a plate material selected from titanium or titanium alloy with said first and second die segments, with a first side of said metal plate held in contact with said convex surface of the first die segment, thereby curving said metal plate while forming at least one rib on the first side of the metal plate through said at least one recess of said convex surface.

6. A method of manufacturing a curved metal plate according to claim 5, wherein said at least one recess comprises at least one recess substantially coaxial to said pointed apex of said convex surface.

7. A method of manufacturing a curved metal plate according to claim 5, wherein said at least one recess comprises at least one recess extending substantially radially from said pointed apex of said convex surface.

8. A method of manufacturing a curved metal plate according to claim 5, wherein said at least one recess comprises at least one recess substantially coaxial to said pointed apex of said convex surface and at least one recess extending substantially radially from said pointed apex of said convex surface.

9. A method of manufacturing a curved metal plate comprising:

preparing a first die segment having a convex surface formed thereon, in which said convex surface is formed with an apex, and said convex surface has at least one recess that has at least a portion orthogonal to a direction along which the convex surface is curved;

preparing a second die segment having a concave surface formed thereon corresponding in shape to said convex surface; and pressing a metal plate made of a plate material selected from titanium or titanium alloy with said first and second die segments, with a first side of said metal plate held in contact with said convex surface of the first die segment, thereby curving said metal plate while forming at least one rib on the first side of the metal plate through said at least one recess of said convex surface.

10. A method of manufacturing a curved metal plate according to claim 9, in which said direction orthogonal to the direction along which said convex surface is curved represents a direction orthogonal to both tangential and normal lines of the outline of the convex surface in a cross-sectional view taken along an imaginary surface that is orthogonal to said axis.

11. A method of manufacturing a curved metal plate according to claim 9, wherein said apex is linear, and said direction along which the convex surface is curved around an axis parallel to the linear apex.

12. A method of manufacturing a curved metal plate according to claim 9, wherein said at least one recess comprises grooves extending orthogonal to the direction along which the convex surface is curved.

13. A method of manufacturing a curved metal plate according to claim 11, wherein said at least one recess comprises at least one hole having a substantially circular shape in plan view.

14. A method of manufacturing a curved metal plate according to claim 11, wherein said at least one recess comprises at least one groove having a linear shape in plan view and at least one groove having a circular shape in plan view.

15. A method of manufacturing a curved metal plate according to claim 9, in which said direction orthogonal to the direction along which said convex surface is curved represents a direction orthogonal to both tangential and normal lines of the outline of the convex surface in a cross-sectional view of an arbitrary point taken along an imaginary surface that extends along the pressing direction.

16. A method of manufacturing a curved metal plate according to claim 9, wherein said apex is pointed.

17. A method of manufacturing a curved metal plate according to claim 16, wherein said at least one recess comprises at least one recess substantially coaxial to said pointed apex of said convex surface.

18. A method of manufacturing a curved metal plate according to claim 16, wherein said at least one recess comprises at least one recess extending substantially radially from said pointed apex of said convex surface.

19. A method of manufacturing a curved metal plate according to claim 16, wherein said at least one recess comprises at least one recess substantially coaxial to said pointed apex of said convex surface and at least one recess extending substantially radially from said pointed apex of said convex surface.

* * * * *